106-84 AU 113 EX
11/11/80 4,233,076

United States Patent [19]
Blanc et al.
[11] 4,233,076
[45] Nov. 11, 1980

[54] NOVEL SAND/SILICATE COMPOSITIONS FOR FOUNDRY MOLDS/CORES

[75] Inventors: Jean-Pierre Blanc, Antony; François Meiller, Palaiseau, both of France

[73] Assignee: Rhone-Poulenc Industries, Paris, France

[21] Appl. No.: 970,793

[22] Filed: Dec. 18, 1978

[30] Foreign Application Priority Data

Dec. 19, 1977 [FR] France ..... 77 38182

[51] Int. Cl.[2] ..... B28B 7/34

[52] U.S. Cl. ..... 106/38.35; 106/38.3; 106/84

[58] Field of Search ..... 106/38.3, 38.35, 84

[56] References Cited

U.S. PATENT DOCUMENTS

| | | | |
|---|---|---|---|
| 2,491,096 | 12/1949 | Feagin | 106/38.35 |
| 2,883,723 | 4/1959 | Moore et al. | 106/38.3 |
| 3,137,046 | 6/1964 | Barlow et al. | 106/38.35 |
| 3,203,057 | 8/1965 | Hunt et al. | 106/38.3 |
| 3,424,600 | 1/1969 | Liass et al. | 106/38.3 |
| 3,558,506 | 1/1971 | Bonnel et al. | 106/38.35 |
| 4,056,937 | 11/1977 | Suzuki | 106/74 |

FOREIGN PATENT DOCUMENTS 2264608 10/1975 France .

*Primary Examiner*—Lorenzo B. Hayes
*Attorney, Agent, or Firm*—Burns, Doane, Swecker & Mathis

[57] ABSTRACT

Foundry mold and core compositions comprising sand, a silicate binder and a hardening agent include an alumina "demolding" agent having an average grain size distribution of less than 40μ, preferably between 0.2 and 5μ.

20 Claims, No Drawings

NOVEL SAND/SILICATE COMPOSITIONS FOR FOUNDRY MOLDS/CORES

BACKGROUND OF THE INVENTION

1. Field of the Invention

The present invention relates to novel compositions for foundry molds and cores, and, more especially, to such compositions comprising a silicate based binder.

2. Description of the Prior Art

It has long been known to this art to prepare foundry cores and molds by utilizing a ternary mixture comprising 93 to 98 parts by weight of a sand suitable for foundry purposes and 2 to 7 parts by weight of an aqueous solution of an alkaline silicate.

Such compositions typically were hardened with carbon dioxide. The process was said to be improved by employing different additives therein, as per French Pat. No. 1,172,636. Finally, an attempt was made to eliminate the use of carbon dioxide gas, especially in the molding of the larger shaped articles, which gaseous hardening agent displayed certain disadvantages, particularly at elevated temperatures.

Thus, in U.S. Pat. No. 3,207,057, it is proposed to use a binder comprising an aqueous solution of an alkaline metal silicate and an additive consisting essentially of 3 to 100% alumina with respect to the binder.

However, it is known that, of these compositions, numerous desirable properties are required. In particular, good mechanical properties are expected of the cores and molds. It is further desired to simultaneously obtain shorter setting times and a relatively extended useful life.

"Useful life" is defined as that period of time during which it is possible to store the mixture of sand, silicate and hardener, without a reduction in mechanical properties, from the moment that the silicate is added to the mixture of sand plus hardener.

"Setting time" is defined as that period of time which intervenes between the moment that the silicate is added to the mixture of sand plus hardener to that point in time when modifications are no longer observed on the surface of the agglomerated sand. In practice, the point of setting is determined simply by exerting pressure on said surface of the sand mix.

The immediately foregoing can be said to characterize those reasons why it has been recently proposed, in French patent application No. 77,131/77, assigned to the assignee hereof, to employ hardening or curing catalysts of aqueous solutions of alkaline silicates based on alkylene carbonates and additionally containing methyl esters of the organic acids.

But even though such hardeners, used in combination with sand and alkaline silicate based binders, afford excellent results as regards ultimate mechanical properties, useful lives and setting times, one problem remains without a satisfactory solution, namely, demolding. "Demolding" is defined as that step of extracting or removing with relative ease the sand located within the cavities formed by the cores, from the metal casting.

In effect, the agglomerated sand comprising the various molds and cores must have a high mechanical strength prior to the pouring of the molten metal and must retain a satisfactory mechanical strength at elevated temperatures, but same should have mechanical properties such that the sand may be readily extracted or removed, once the metal has cooled.

To facilitate demolding, it too is known to this art to employ certain carbonaceous materials and/or film-forming resineous adhesives [French Pat. No. 2,237,706], but the phenomenon of recarburization may occur.

SUMMARY OF THE INVENTION

It has now surprisingly been found, and which is a major object of the present invention, that the aforenoted problems may be obviated by utilizing foundry mold and core compositions comprising sand, a binder based upon an alkaline silicate, and a hardening agent, by including in such compositions a demolding agent which comprises, at least in part, an alumina having an average grain size of less than 40μ, and preferably an average grain size of between 0.2 and 5μ.

Further, the alumina incorporated according to the invention advantageously has a B.E.T. surface of less than 300 $m^2/g$, and preferably between 3 and 40 $m^2/g$.

According to an especially advantageous embodiment of the invention, $Al_2O_3.3H_2O$ alumina is incorporated.

DETAILED DESCRIPTION OF THE INVENTION

In practice and preferentially, the compositions of the invention comprise 90 to 98 parts by weight of sand, 2 to 10 parts by weight of a solution of an alkaline silicate, and 0.5 and 5% by weight of the alumina, preferably from 0.8 to 1.7% by weight of the alumina.

The silicate according to the invention preferably has a $SiO_2/Na_2O$ weight ratio comprised between 2 and 2.7. As the hardener, there may specifically be utilized a compound selected from the group comprising the alkylene carbonates and/or organic acids, notably the methylics and particularly methyl esters of organic monoacids, optionally substituted with other functional groups, such as methyl lactate; same may also be dimethyl esters of organic diacids, such as α,ω-aliphatic diacids having from three to ten carbon atoms, such as, for example, malonic acid, succinic acid, glutaric acid and adipic acid.

The cyclic alkylene carbonates envisaged typically are characterized by an alkylene radical preferably having two to six carbon atoms; those carbonates typically employed are ethylene carbonate and propylene carbonate.

In general, 4 to 30 parts by weight of the methyl ester of an organic acid are employed per 96 to 70 parts by weight of the alkylene carbonate; optionally, the mixture may be diluted with a solvent which controls the reactivity with the alkaline silicate. As such solvents, aliphatic polyols, and preferably the polyalkylene glycols, may be used, for example, diethylene glycol. These solvents may be used, for example, in an amount of 2 to 20 parts by weight per 100 parts by weight of the alkylene carbonate/methyl ester hardener.

The processes employed to obtain or fabricate a mold or a core for foundry use are those conventionally employed in this technology, such as described, for example, in U.S. Pat. No. 3,307,046 or French Pat. No. 2,264,608. In particular, it is possible to operate at ambient temperature, i.e., roughly between 0° and 30° C.

EXAMPLES

In order to further illustrate the present invention and the advantages thereof, the following specific examples are given, it being understood that same are intended only as illustrative and in nowise limitative.

In the examples which follow, the following mode of operation was employed:

Into a Kenwood planetary mixer, the components of the mixture were introduced, at a temperature comprised between 18° and 20° C., and in the following order:

(i) 1 kg Sifraco sand (reference AFA 53–57);

(ii) 5 g of the hardener under a first stirring or mixing of 1 min. 30 sec.;

(iii) 35 g of an aqueous solution of sodium silicate (with a second mixing of 45 seconds).

The sodium silicate solution had a water content of 55.2% and a net extract of 44.8%. The $SiO_2/Na_2O$ weight ratio was equal to 2.39, the density at 20° C. was 1.525 and the viscosity was 600 cPs at 20° C.

The hardener consisted of a mixture of 86.25 parts by weight of propylene carbonate and 13.75 parts of methyl lactate.

The sand utilized had the following properties: specific surface area, 115 $cm^2/g$; apparent density, 1.5; heating loss, 0.15%. It contained a minimum of 99.7% $SiO_2$ and a maximum of 0.1% clay with traces of calcium carbonate. Its grain size distribution was:

1% larger than 420μ;

26% comprised between 420 and 300μ;

47% comprised between 300 and 210μ;

23% comprised between 210 and 150μ; and

3% comprised between 150 and 105μ.

In a first series of examples [Examples 1 to 8], the nature and the proportions of demolding agent were varied, as was its grain size distribution. The results were obtained by means of two tests: compression testing and friability.

Compression Testing

Following formulation of the molding mixture (sand+hardener+silicate) in the Kenwood planetary mixer, in four minutes, in a core box, 6 compression test specimens were prepared. The latter, having a diameter of 5 cm and a height of 5 cm, were stored in the absence of air, prior to measuring their compression strength at time intervals of between 10 min. and 1 hour, with the +GF testing machine, type SPDR. As in the preceding tests, the time basis was the moment of the introduction of the silicate.

Friability Test

The specimen was heated to the indicated temperature of 500° C., 750° C. or 1000° C. over 30 min., then subjected to the pressure and assigned a value or grade comprised between 0 and 5. The grade 0 reflects an integral preservation of the initial cohesion while the grade 5 denotes destruction of this cohesion.

Table I reflects that, for alumina of excessive grain size (Examples 1 to 5), it is difficult to obtain a good compromise between mechanical properties and demolding.

Examples 6 and 7 illustrate the influence of small grain sizes, all other conditions being equal.

Example 8 shows the influence of the specific surface in the case of small grain sizes.

Table II reproduces a series of examples in which other agents were used. It is clearly seen that it is then impossible to obtain good demolding behavior together with acceptable mechanical properties.

Finally, in Table III, the examples of Table I are repeated, but with the substitution of another hardener consisting of:

| | |
|---|---|
| MD 20 | (1) 80% of a mixture of methyl adipate ester, methyl glutarate ester and methyl succinate ester; and (2) 20% diethylene glycol. |

The different examples thus clearly show the influence of each of the parameters of the invention and the synergistic effect thereof according to invention.

It is, however, not beyond the scope of the invention to use another hardener, such as carbon dioxide or a blast furnace slag.

Under the conditions of the aforementioned examples, in particular, utilizing the same sand, a hardener consisting of carbon dioxide, and an alumina according to Example 6 (Table I); the mixture comprised 100 parts by weight of sand, and 3.5 parts silicate.

An increase in mechanical properties was noted after 10 seconds of gas hardening under a pressure of 2 kg and after 30 seconds under a pressure of 2 kg. The results are summarized in the tables which follow:

| 10 Seconds of gas hardening under 2 kg pressure | Compression strength |
|---|---|
| with 0% alumina | 12 $kg/cm^2$ |
| with 0.5% alumina | 15 $kg/cm^2$ |
| with 1.0% alumina | 18 $kg/cm^2$ |
| with 1.8% alumina | 23 $kg/cm^2$ |

| 30 Seconds of gas hardening under 2 kg pressure | Compression strength |
|---|---|
| with 0% alumina | 19 $kg/cm^2$ |
| with 0.5% alumina | 22 $kg/cm^2$ |
| with 1.0% alumina | 26 $kg/cm^2$ |
| with 1.8% alumina | 30 $kg/cm^2$ |

| Friability at 1000° C. |
|---|
| alumina 0% = 0 |
| alumina 0.5% = 0.5 |
| alumina 1.0% = 2.0 |
| alumina 1.8% = 4 |

An improvement in properties was also noted with another hardener consisting of a blast furnace slag having the following composition by weight:

42–46% CaO

32–34% $SiO_2$

13–16% $Al_2O_3$ 3.5–5% MgO

And having a basicity index of $CaO/SiO_2$=1.3 to 1.15.

The operating conditions were the same as above, with a mixture comprising:

for 100 parts by weight of sand:

(i) 6 parts of slag, and (ii) 5 parts of silicate with a weight ratio equal to 2.

After 7 hours, the following results were obtained:

| Compression strength |
|---|
| 0% alumina = 18 $kg/cm^2$ |

-continued

| Compression strength |
|---|
| 0.5% alumina = 21 kg/cm$^2$ |
| 1.0% alumina = 23 kg/cm$^2$ |
| 1.8% alumina = 24 kg/cm$^2$ |

| Friability at 1000° C. |
|---|
| 0% alumina = 0 |
| 0.5% alumina = 0.5 |
| 1.0% alumina = 1.5 |
| 1.8% alumina = 3.5 |

TABLE I

| Example | Ingredient | S m$^2$/g | Water of Crystallization % | Grain Size Distribution 100 μ | 60 μ | 30 μ | 10 μ | 5 μ | 8 μ | 1 μ | 0.4 μ | 0.1 μ |
|---|---|---|---|---|---|---|---|---|---|---|---|---|
| 1 | Without Additive | | | | | | | | | | | |
| 2 | $Al_2O_3 . 3 H_2O$ | 5 | 35 | 85 | 45 | 15 | 4 | 2 | | | | |
| | " | " | " | " | " | " | " | " | | | | |
| 3 | $Al_2O_3 . 3 H_2O$ | 5 | 35 | 100 | 96 | 45 | 8 | 4 | | | | |
| | " | " | " | " | " | " | " | " | | | | |
| 4 | $Al_2O_3 . 3 H_2O$ | 5 | 35 | 100 | 100 | 85 | 30 | 15 | | | | |
| | " | " | " | " | " | " | " | " | | | | |
| 5 | $Al_2O_3 . 3 H_2O$ | 5 | 35 | 100 | 100 | 95 | 45 | 25 | | | | |
| | " | " | " | " | " | " | " | " | | | | |
| | " | " | " | " | " | " | " | " | | | | |
| 6 | $Al_2O_3 . 3 H_2O$ | 5 | 35 | | | | | | 100 | 95 | 50 | 20 |
| | " | " | " | | | | | | " | " | " | " |
| | " | " | " | | | | | | " | " | " | " |
| 7 | $Al_2O_3 . 3 H_2O$ | 7 | 35 | | | | | | 100 | 85 | 28 | |
| | " | " | " | | | | | | " | " | " | |
| 8 | $Al_2O_3 . 3 H_2O$ | 35 | 35 | | | | | | | | | |
| | " | 9 | 35 | | | | | | | | | |
| | " | 14 | 35 | | | | | | | | | |
| | " | 32 | 35 | | | | | | | | | |

TABLE Ia

| Example | Crystallography | % Sand Demolding Agent | R/Compression Kg/cm$^2$ 20 mn | 40 mn | 24 hr | Friability at °C. 500° | 750° | 1000° |
|---|---|---|---|---|---|---|---|---|
| 1 | | | 11 | 20 | 46 | 0 | 0 | 0 |
| 2 | Hydrargillite | 1.2 | 16 | 24 | 45 | 0 | 0.5 | 0.5 |
| | " | 3.0 | 14 | | 35 | 0 | 0.5 | 0.5 |
| 3 | Hydrargillite | 1.2 | 18 | 25 | 44 | 0 | 0.5 | 0.5 |
| | " | 3.0 | 10 | | 36 | 0 | 0.5 | 0.5 |
| 4 | Hydrargillite | 1.2 | 19 | 26 | 39 | 0 | 0.5 | 0.5 |
| | " | 3.0 | 16 | | 40 | 0.5 | 1.5 | 3 |
| 5 | Hydrargillite | 1.2 | 19 | 20 | 41 | 0 | 0.5 | 1 |
| | " | 3.0 | 20 | | 38 | 1.5 | 5 | 5 |
| | " | 1.7 | 15 | 22 | 45 | | 2 | 3.5 |
| 6 | Hydrargillite | 0.8 | 19 | 29 | 48 | 1.0 | 1.0 | 1.0 |
| | " | 1.2 | 18 | 28 | 50 | 1.0 | 1.5 | 3.5 |
| | " | 3.0 | 17 | | 39 | 2.5 | 5 | 5 |
| | " | 1.7 | 14 | 21 | 45 | | 4 | 5 |
| 7 | Hydrargillite | 1.2 | 16 | 25 | 45 | 1.0 | 1.5 | 3.0 |
| | " | 1.7 | 17 | 27 | 44 | | | |
| | " | 1.7 | 19 | 29 | 44 | | | |
| 8 | Hydrargillite | 1.2 | 15 | 24 | 46 | 0.5 | 1.5 | 3.0 |
| | " | 1.2 | 16 | 24 | 50 | 0.5 | 2.0 | 3.5 |
| | " | 1.2 | 18 | 22 | 44 | 0.5 | 3.0 | 3.0 |
| | " | 1.2 | 17 | 24 | 25 | 0.5 | 3.5 | 4.0 |

TABLE II

| Ingredient | Sand Demolding Agent | R/Compression 20 mn | 40 mn | 24 hr | Friability 2500° C. | 850° C. | 1000° C. |
|---|---|---|---|---|---|---|---|
| $SiO_2$ | 0.35 | 27 | | 25 | 0 | 0.5 | 1.5 |
| " | 0.70 | 31 | | 34 | 0 | 0.5 | 1.0 |
| " | 1.0 | 30 | | 28 | 0 | 0.5 | 1.0 |
| " | 1.75 | 30 | | 28 | 0 | 0.5 | 1.0 |
| " | 2.60 | 32 | | 20 | 0 | 0.5 | 1.0 |
| " | 3.5 | 30 | | 18 | 0 | 0.5 | 2.5 |
| Alumina Sulfate | 1.5 | 0 | 0 | 0 | | | |
| " | 3.0 | 0 | 0 | 0 | | | |
| " | 0.8 | 4 | 1 | 2 | | 5 | 5 |
| " | 0.3 | 8 | 14 | 26 | | 1 | 2.5 |

TABLE III

| Designation | Sand Demolding Agent | R/Compression in Kg/cm² After 3 days | After 4 days | Friability in °C. 500° | 750° | 1000° |
|---|---|---|---|---|---|---|
| Without Additive | | 45 | 62 | 0 | 0 | 0 |
| $Al_2O_3 . 3 H_2O$ | 2 | 45 | 62 | 0.5 | 3 | 5 |
| Flash Dried Alumina | 2 | 37 | 49 | 0.5 | 1 | 3 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. In a moldable composition of matter comprising an intimate uniform admixture of sand, an alkali metal silicate, and at least one of a hardening agent; selected from the group consisting of an alkylene carbonate, an organic monocarboxylic or dicarboxylic acid or methyl ester thereof, carbon dioxide and blast furnace slag; the improvement comprising a demolding agent which comprises an alumina having an average grain size distribution of between 0.2 and 5μ.

2. The composition of matter as defined by claim 1, wherein the alumina has a B.E.T. surface of less than 300 $m^2/g$.

3. The composition of matter as defined by claim 2, wherein the alumina has a B.E.T. surface of between 3 and 40 $m^2/g$.

4. The composition of matter as defined by claim 1, said alumina comprising $Al_2O_3.3H_2O$.

5. The composition of matter as defined by claim 1, comprising from 90 to 98 parts by weight sand, 2 to 10 parts by weight silicate, and 0.5 to 5% by weight alumina.

6. The composition of matter as defined by claim 5, comprising from 0.8 to 1.7% by weight alumina.

7. The composition of matter as defined by claim 1, said alkali metal silicate comprising $SiO_2$ and $Na_2O$, in a $SiO_2/Na_2O$ weight ratio of between 2 and 2.7.

8. The composition of matter as defined by claim 1, said hardening agent comprising an alkylene carbonate.

9. The composition of matter as defined by claim 8, said alkylene carbonate being selected from the group consisting of ethylene carbonate and propylene carbonate.

10. The composition of matter as defined by claim 1, said hardening agent comprising an organic monocarboxylic acid or methyl ester thereof.

11. The composition of matter as defined by claim 1, said hardening agent comprising an organic dicarboxylic acid or methyl ester thereof.

12. The composition of matter as defined by claim 1, said hardening agent comprising a member selected from the group consisting of malonic acid, succinic acid, glutaric acid, adipic acid and the methyl ester thereof.

13. The composition of matter as defined by claim 1, said hardening agent comprising from 4 to 30 parts by weight of said organic carboxylic acid and 96 to 70 parts by weight of said alkylene carbonate.

14. The composition of matter as defined by claim 1, wherein said silicate is in solution.

15. The composition of matter as defined by claim 1, wherein said hardening agent is in solution.

16. The composition of matter as defined by claim 15, wherein said solvent is an aliphatic polyol.

17. The composition of matter as defined by claim 1, said hardening agent comprising carbon dioxide.

18. The composition of matter as defined by claim 1, said hardening agent comprising blast furnace slag.

19. A shaped article comprising the composition of matter as defined by claim 1.

20. A foundry mold comprising the composition of matter as defined by claim 1, in cured state.

* * * * *